US012709960B1

(12) United States Patent
AlSultan et al.

(10) Patent No.: US 12,709,960 B1
(45) Date of Patent: Aug. 18, 2026

(54) WELLBORE COMPLETION

(71) Applicant: Saudi Arabian Oil Company, Dhahran (SA)

(72) Inventors: Fuad A. AlSultan, AlAhsa (SA); Muslim Al-Hassan, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/204,876

(22) Filed: May 12, 2025

(51) Int. Cl.

| | |
|---|---|
| ***E21B 34/14*** | (2006.01) |
| ***E21B 33/124*** | (2006.01) |
| ***E21B 41/00*** | (2006.01) |
| ***E21B 47/07*** | (2012.01) |

(52) U.S. Cl.
CPC ..... *E21B 34/14* (2013.01); *E21B 33/124* (2013.01); *E21B 41/0035* (2013.01); *E21B 47/07* (2020.05)

(58) Field of Classification Search
CPC ..... E21B 34/14; E21B 23/12; E21B 47/07; E21B 33/124; E21B 41/0035
See application file for complete search history.

(56) References Cited

U.S. PATENT DOCUMENTS 5,941,308 A 8/1999 Malone et al.
6,311,776 B1 * 11/2001 Pringle ..... E21B 41/0035 166/117.6
8,701,770 B2 * 4/2014 Schultz ..... E21B 41/0042 166/50
11,692,417 B2 * 7/2023 Rowaihy ..... E21B 43/14 166/250.01
2001/0009189 A1 * 7/2001 Brooks ..... E21B 23/02 166/242.6
2002/0112857 A1 8/2002 Ohmer et al.
2010/0276158 A1 * 11/2010 Ingraham ..... E21B 23/12 166/241.1

OTHER PUBLICATIONS

Ameen et al., "Multilateral Completion Technology to Improve Reservoir Management," presented at the 2023 SPE Annual Technical Conference and Exhibition, San Antonio, Texas, Oct. 16-18, 2023, 13 pages.
Arukhe et al., "Smart Well Completion Optimization in Multilateral Wells," presented at the Abu Dhabi International Petroleum Exhibition & Conference, Abu Dhabi, UAE, Nov. 13-16, 2017, 10 pages.

* cited by examiner

*Primary Examiner* — Yong-Suk (Philip) Ro
(74) *Attorney, Agent, or Firm* — Fish & Richardson P.C.

(57) ABSTRACT

A wellbore completion includes a housing and a mandrel. The housing is coupled with a wellbore string disposed within a well that includes a first wellbore and a second wellbore extending from the first wellbore. The housing resides at the juncture and includes fluid port, a first fluid inlet fluidly coupled with the first wellbore, and a second fluid inlet fluidly coupled with the second wellbore. The mandrel includes a first fluid conduit and a second fluid conduit and is rotatable to position the mandrel in a first position, in which the first fluid conduit is aligned with the fluid port and the first fluid inlet to open a fluid pathway from the first wellbore, or a second position, in which the second fluid conduit is aligned with the fluid port and the second fluid inlet to open a second fluid pathway from the second wellbore.

20 Claims, 6 Drawing Sheets

WELLBORE COMPLETION

TECHNICAL FIELD

This disclosure relates to wellbore completions, and more particularly to dual lateral completions.

BACKGROUND

A wellbore completion refers to the process and equipment used to prepare an oil or gas well for production. The wellbore completion equipment ensures the safe and efficient extraction of hydrocarbons from underground reservoirs. Dual lateral completion equipment allows a well to be produced from multiple lateral wellbores or reservoirs. Improvements to dual lateral completion equipment and methods are sought.

SUMMARY

Implementations of the present disclosure include a wellbore completion that includes a housing and a mandrel. The housing is coupled with a downhole end of a wellbore string disposed within a well. The well includes a first wellbore and a second wellbore extending from the first wellbore at a juncture of the well. The housing resides at or near the juncture and includes fluid port fluidly coupled with the wellbore string, a first fluid inlet fluidly coupled with the first wellbore, and a second fluid inlet fluidly coupled with the second wellbore. The mandrel is disposed within the housing and resides downhole of the fluid port. The mandrel includes a first fluid conduit and a second fluid conduit. The mandrel is rotatable to position the mandrel in a first position, in which the first fluid conduit is aligned with the fluid port and the first fluid inlet to open a fluid pathway from the first wellbore to the wellbore string, or a second position, in which the second fluid conduit is aligned with the fluid port and the second fluid inlet to open a second fluid pathway from the second wellbore to the wellbore string.

In some implementations, the mandrel is rotatable by an electric motor, the electric motor controllable from a terranean surface of the well. In some implementations, the wellbore completion further includes a controller disposed at the terranean surface of the well and a cable coupled with the controller and the electric motor to transmit information from the controller to the electric motor to control the electric motor.

In some implementations, the first wellbore is a vertical wellbore and the second wellbore is a non-vertical wellbore. In some implementations, the housing is a completion housing coupled with production tubing residing downhole of the housing and disposed within the first wellbore. The production tubing is fluidly coupled with the first fluid inlet of the completion housing.

In some implementations, the wellbore completion further includes a flapper valve coupled with the production tubing, the flapper valve operable to open or close a fluid pathway from the production tubing to the completion housing. In some implementations, the flapper valve is operable by a linear actuator, the linear actuator controllable from a terranean surface of the well. In some implementations, the wellbore completion further includes a controller disposed at the terranean surface of the well and a cable coupled with the controller and the linear actuator to transmit information from the controller to the linear actuator to open or close the flapper valve. In some implementations, the linear actuator is a hydraulic actuator including a spring-loaded tube movable under pressure of a fluid flowed by a fluid pump, the fluid pump operable by the controller to either (i) push, with the fluid, the spring-loaded tube downhole to open the flapper valve, or (ii) reduce a pressure of the fluid to allow a spring of the spring-loaded tube to push the spring-loaded tube uphole to close the flapper valve.

Implementations of the present disclosure also include a wellbore assembly that includes a housing and a mandrel. The housing is configured to be coupled with a wellbore string. The housing resides at or near a juncture between a first wellbore and a second wellbore. The housing has a fluid port that is, with the housing coupled with the wellbore string, fluidly coupled with the wellbore string. The mandrel is coupled with the housing and resides downhole of the fluid port. The mandrel includes a first fluid conduit and a second fluid conduit. The mandrel is rotatable to at least one of (i) align the first fluid conduit with the fluid port and the first wellbore to open a first fluid pathway from the first wellbore to the wellbore string, or (ii) align the second fluid conduit with the fluid port and the second wellbore to open a second fluid pathway from the second wellbore to the wellbore string.

In some implementations, the wellbore assembly further includes a sliding sleeve door (SSD) coupled with the wellbore string and residing uphole of the housing. The SSD is configured to open or close a fluid pathway between the second wellbore and the production string. In some implementations, the wellbore assembly further includes a first packer residing uphole of the SSD and a downhole packer residing downhole of the mandrel. The juncture is disposed between the first packer and the second packer such that the first packer isolates the second wellbore from an annulus uphole of the first packer and the second packer isolates the first wellbore from the second wellbore.

In some implementations, the wellbore assembly further includes a controller electrically coupled with and configured to control an electric motor coupled with the mandrel to rotate the mandrel in response to receiving information from the controller.

In some implementations, the wellbore assembly further includes a flapper valve coupled downhole of the housing. The flapper valve is operable by a linear actuator. The controller is electrically coupled with and configured to control the linear actuator to open or close the flapper valve in response to receiving information from the controller to regulate a flow of fluid from the vertical wellbore into the housing. In some implementations, the linear actuator is a hydraulic actuator including a spring-loaded tube movable under pressure of a fluid flowed by a fluid pump, the fluid pump operable by the controller to either (i) push, with the fluid, the spring-loaded tube downhole to open the flapper valve, or (ii) reduce a pressure of the fluid to allow a spring of the spring-loaded tube to push the spring-loaded tube uphole to close the flapper valve.

In some implementations, the first wellbore is a vertical wellbore and the second wellbore is a non-vertical wellbore.

In some implementations, the wellbore assembly further includes a sensor coupled with the mandrel. The sensor is communicatively coupled with a receiver and configured to transmit sensor feedback to the receiver. The sensor feedback includes an orientation of the mandrel to guide at least one of (i) a placement of the housing at the juncture, or (ii) a rotation of the mandrel with respect to the housing to open or close the first fluid pathway or second fluid pathway.

Implementations of the present disclosure incudes a method that includes rotating a mandrel of a wellbore completion assembly. The wellbore completion assembly includes a housing and a mandrel. The housing is coupled with a wellbore string and resides at or near a juncture between a first wellbore and a second wellbore. The housing includes fluid port fluidly coupled with the wellbore string. The mandrel is coupled with the housing and resides downhole of the fluid port. The mandrel includes a first fluid conduit and a second fluid conduit. The mandrel is rotatable to at least one of (i) align the first fluid conduit with the fluid port and the first wellbore, or (ii) align the second fluid conduit with the fluid port and the second wellbore. Rotating the mandrel includes rotating the mandrel to align the first fluid conduit with the fluid port and the first wellbore, opening a first fluid pathway extending from the first wellbore to the wellbore string. The method also includes rotating the mandrel to align the second fluid conduit with the fluid port and the second wellbore, closing the first fluid pathway and opening a second fluid pathway extending from the second wellbore to the wellbore string.

In some implementations, the method further includes, before rotating the mandrel to open the first fluid pathway, determining, by controller and as a function of sensor feedback or an operator input, that the first fluid pathway is to be opened. In some implementations, the sensor feedback is sensor feedback from one or more sensors coupled with the wellbore string, the sensor feedback including at least one of a flow rate, pressure, or temperature of production fluid in the wellbore string.

Particular implementations of the subject matter described in this specification can be implemented so as to realize one or more of the following advantages. For example, the wellbore completion of the present disclosure can help minimize the number of the required intervention runs needed to switch access from vertical lateral to horizontal lateral. The wellbore completion also allows regulating the flow of fluid between laterals from the surface, which can be done manually or automatically. The wellbore completion can also help reduce the surface footprint of the equipment compared to other well intervention equipment.

DETAILED DESCRIPTION OF THE DISCLOSURE

The present disclosure describes a completion for a well that has multiple wellbores. For example, the well can have dual laterals (e.g., stacked dual laterals or planar dual laterals), one or more radial laterals extending from a main wellbore, or any configuration in which two or more wellbores extend from a common junction. The completion allows switching access from a first wellbore (e.g., a vertical wellbore or lateral) to a second wellbore (e.g., a horizontal wellbore or lateral) by using a rotatable mandrel that can be controlled from the surface of the well. The rotating mandrel is located at the entry of the horizontal zone to switch access between the wellbores extending from the juncture.

Figure 1:
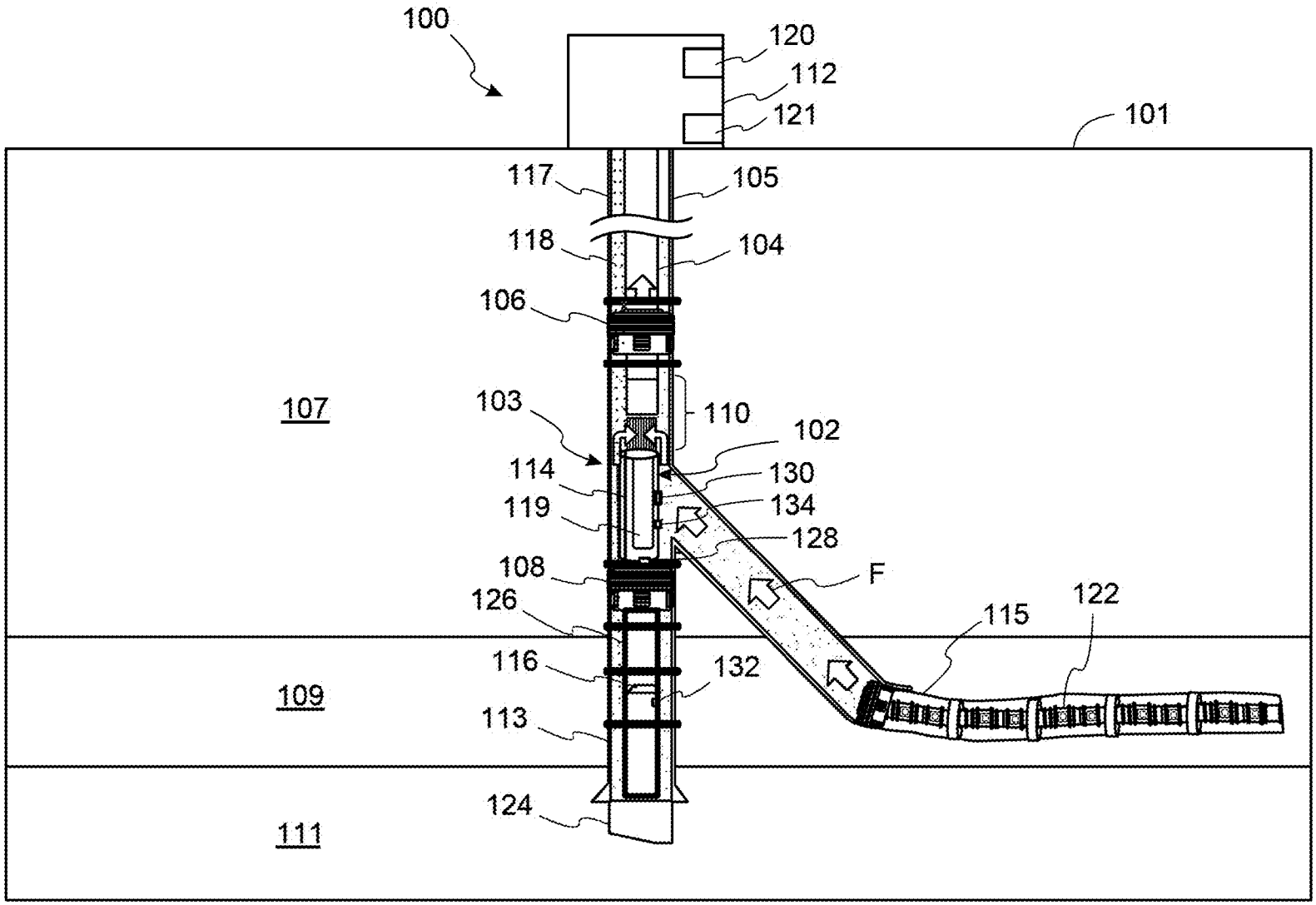
FIG. 1 shows a front schematic view, partially cross-sectional, of an example wellbore assembly producing from a non-vertical wellbore.

FIG. 1 shows a front schematic view, partially cross sectional, of a wellbore assembly 100 (e.g., a completion assembly) that includes a completion 102 (e.g., a dual lateral completion) and a wellbore string 104 (e.g., a production string) disposed within a well 105. The wellbore string 104 extends from and is attached to surface equipment 112 such as a wellhead, a Christmas tree, a rig, etc.

The well 105 extends through a subterranean zone 107 that includes geologic formations 109, 111 (e.g., subterranean layers or zones). For example, the well 105 extends down from a surface 101 (e.g., a terranean surface) of the well 105 into the geologic formations 109, 111. In some aspects, the geologic formations 109, 111 include a reservoir from which fluid "F" (e.g., production fluid such as hydrocarbons including oil or gas, or other wellbore fluids such as water) can be extracted. In some aspects, the subterranean zone 107 includes only one formation or more than two formations.

The well 105 includes two or more wellbores 113, 115. For example, the well 105 includes a vertical wellbore 113 and a non-vertical wellbore 115. For example, the well 105 includes a main vertical wellbore 117 and a non-vertical wellbore 115 (e.g., a deviated wellbore, a radial wellbore, a horizontal wellbore, etc.) extending from the vertical wellbore 117. The main wellbore 117 includes downhole wellbore 113 (e.g., a downhole section) that is downhole of the point at which the non-vertical wellbore 115 meets the main wellbore 117. The downhole wellbore 113 can be vertical or non-vertical. For example, both wellbores 113, 115 can be non-vertical wellbores such as lateral wellbores. In some aspects, other non-vertical wellbores extend from the vertical wellbore 117 (including at the junction 103) so that the well 105 includes multiple lateral wellbores.

The non-vertical wellbore 115 meets the vertical wellbore 117 at a juncture 103. For example, the non-vertical wellbore 115 and the vertical wellbore 117 form the juncture 103 from which the non-vertical wellbore 115 extends. In some aspects, the vertical wellbore 117 can be vertical or at a slight angle, being substantially vertical. In some aspects, the juncture 103 can be at the point in which multiple lateral or non-vertical wellbores extend from a main wellbore, in which the main wellbore is a vertical or horizontal wellbore.

In some aspects, the wellbore assembly 100 also includes production equipment 122 (e.g., packers, production tubing, casing, completions, etc.) that resides within the non-vertical wellbore 115. In some aspects, the wellbore assembly 100 also includes downhole production tubing 126 that resides within the vertical section 113 of the well 105. In some aspects, the vertical section 113 includes an open hole section 124 from which fluid "F" enters the well 105 from the formation 111. In some aspects, the non-vertical wellbore 115 also has an open hole section to allow the fluid "F" to enter the non-vertical wellbore 115 from the formation 109.

The wellbore assembly 100 also includes a first packer 106 (e.g., a retrievable production packer), a second packer 108 (e.g., a retrievable production packer), a sliding sleeve door (SSD) 110, and a valve 116 (e.g., a flapper valve, or a one-way valve) coupled to the tubing. In some aspects, the first packer 106, SSD 110, and housing 114 (e.g., completion housing) are coupled with or are part of the wellbore string 104, and the second packer 108 and valve 116 are coupled with or are part of the downhole tubing 126. In some aspects, the downhole tubing 126 is part of the wellbore string 104. The juncture is between the two packers such that the first packer 106 isolates the second wellbore from an annulus uphole of the first packer 106 and the second packer 108 isolates the first wellbore from the second wellbore.

The SSD 110 resides between the first packer 106 and the second packer 108, with the first packer 106 being uphole of the second packer 108 and the SSD 110. The completion 102 resides between the second packer 108 and the SSD 110. The valve 116 resides downhole of the second packer 108. In some aspects, the SSD 110 is opened and closed by a shifting tool attached to a wireline or coiled tubing string that is lowered into the wellbore and retrieved from the wellbore as needed.

The completion 102 includes a housing 114 and a mandrel 119. The housing 114 is coupled with the wellbore string 104. For example, the housing 114 is coupled with a downhole end of the wellbore string 104. The housing resides at or near the juncture 103 of the well 105. As further described in detail below with respect to FIGS. 3 and 4, the housing 114 is fluidly coupled with the wellbore string 104 and has a first fluid inlet 128 and a second fluid inlet 130. The first fluid inlet 128 is fluidly coupled with the first wellbore 113 and the second fluid inlet is fluidly coupled with the second wellbore 115. The mandrel 119 resides inside the housing 114 and rotate to open or close the fluid inlets 128, 130.

Figure 2:
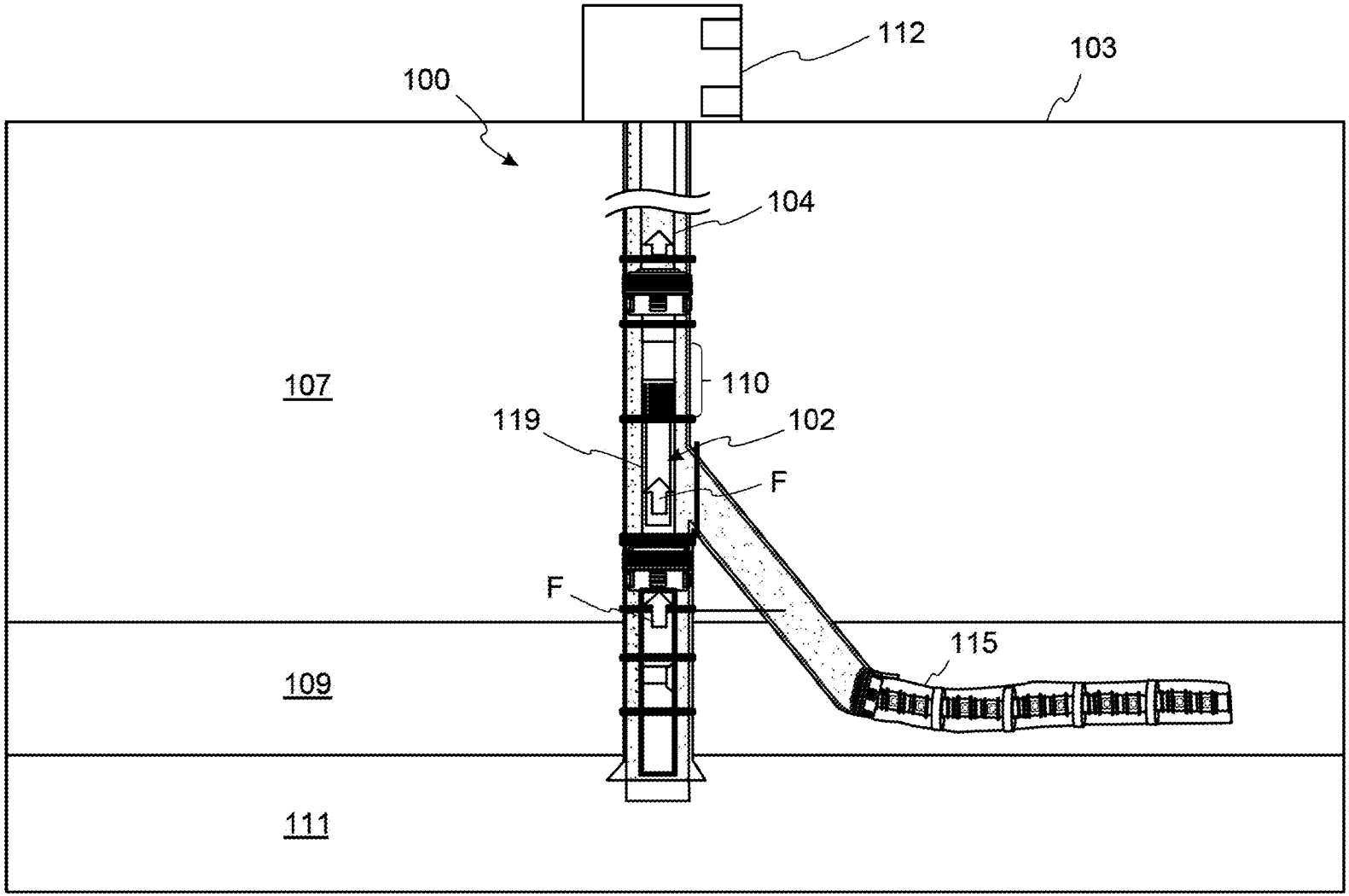
FIG. 2 shows a front schematic view, partially cross-sectional, of an example wellbore assembly producing from a vertical wellbore.

For example, referring also to FIG. 2, the mandrel 119 is rotatable to be positioned in a first position (as shown in FIG. 2) to open the first fluid port 128, forming a first fluid conduit. In the first position, the mandrel connects the vertical wellbore 113 to the surface, allowing the well to produce from the vertical wellbore 113. In other words, the first fluid conduit extends from the downhole production tubing 126 to the wellbore string 104 via the mandrel 119 (with the second fluid conduit closed). As shown in FIG. 1, the mandrel can also rotate to a second position to open the second fluid port 130, closing the first fluid conduit and port 128 and forming a second fluid conduit that extends from the non-vertical wellbore 115 to the wellbore string via the mandrel 130. In other words, the mandrel 119 rotates to switch production between the vertical wellbore 113 and the non-vertical wellbore 115, producing hydrocarbons from one or the other. FIG. 1 shows the completion 102 with the second fluid port 130 opened to allow production from the non-vertical wellbore 115.

Moreover, the production fluid "F" can enter the wellbore string 104 through the SSD 110. For example, the flow from the horizontal wellbore 115 can be either through the SSD 110 (if opened) or from the mandrel 119 (if aligned). Thus, the rotating mandrel 119 provides an additional opening for increasing production or for accessing the horizontal laterals to carry out well intervention jobs through wireline or coiled tubing units.

In some aspects, as further described in detail below with respect to FIG. 1, the mandrel 119 is movable by a motor or actuator that is controllable from the surface 101. For example, the completion 102 is electrically connected with a controller 120 (e.g., a processor including a receiver and a transmitter) at or near the surface 101 of the well 115. The controller 120 controls the motor of the mandrel 119 to rotate the mandrel 119. The controller can also be in a remote location, be part of a mobile device or computer, etc. In some aspects, the controller 120 is connect to the mandrel motor through a cable 118. The cable 118 can provide power and communication or other data to control the mandrel 119. In some aspects, the cable 118 can power and transmit instructions to other components of the completion. In some aspects, the mandrel 119 can be installed as an integral part of the tubing string, allowing tubing connections above and below it for seamless integration into the completion.

The valve 116 can regulate the flow of fluid through the vertical section. In some aspects, the valve 116 is operable to open or close a fluid pathway from the production tubing to the completion housing 114. The controller 120 can control the valve 116 to operate the valve to close or open production through the vertical wellbore. In some aspects, as further described in detail below with respect to FIGS. 5-6, the surface equipment 112 includes a hydraulic pump 121 that, instead of the controller 120, controls the valve 116. For example, the hydraulic pump 121 can be part of a hydraulic circuit or mechanism that opens and closes the valve 116. In some aspects, the valve 116 allows closing and opening the well without well intervention by wireline or coiled tubing units. In some aspects, the valve 116 is controlled through the same control panel at surface as the mandrel.

The controller 120 can be or be part of a computer system that includes one or more processors and a computer-readable medium storing instructions executable by the one or more processors to perform the operations described here. In some implementations, the controller 120 can be implemented as processing circuitry, firmware, software, or combinations of them. In some aspects, the controller 120 is or is part of a control panel at surface.

In some aspects, the mandrel 119 is rotated based on well parameters such as production rate, pressure, temperature, etc. For example, the controller 120 can rotate the mandrel 119 as a function of sensor feedback received from one or more sensors 132, 134 that detect parameters of the production fluid in one or both of the wellbores 113, 115. The sensors 132, 134 can be located anywhere along the well, wellbore assembly 100, or at the surface of the well. The controller 120 can determine, as a function of sensor feedback from the sensors 132, 134, that the first or second fluid pathway is to be opened. In some aspects, in addition to or instead of the sensor feedback, the controller can control the mandrel as a function of operator input FIG. 2 shows the wellbore assembly 100 with the mandrel 119 in the first position. In the first position, the first fluid inlet 128 is blocked and the second fluid inlet 130 is open to form the second fluid pathway from the non-vertical wellbore 115 to the wellbore string 104. With the mandrel 119 open to the non-vertical wellbore 115, the production fluid "F" flows from the non-vertical wellbore 115 into the production string 104 to the surface 101. In some aspects the production fluid "F" flows into the production string through the mandrel 119, the SSD 110, or both.

Figure 4:
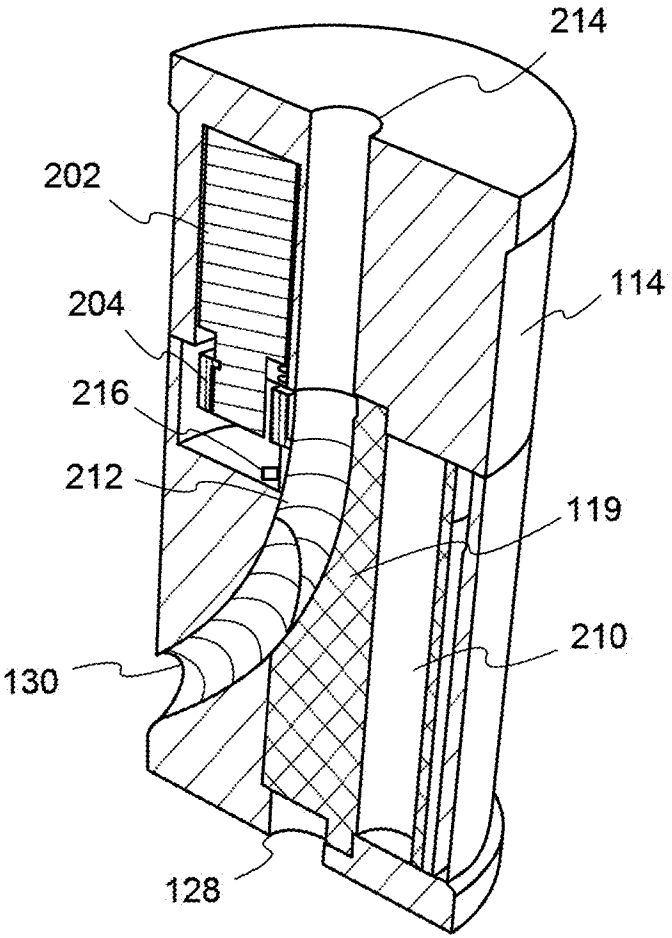
FIG. 4 shows a perspective, cross-sectional view of the completion of the wellbore assembly.
Figure 3:
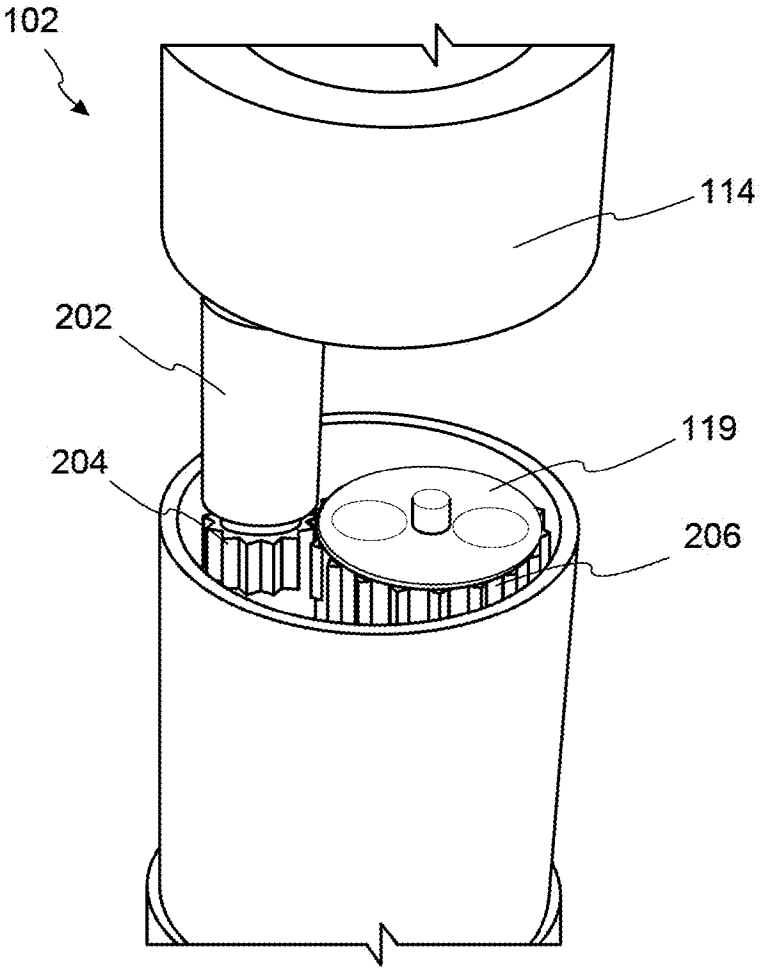
FIG. 3 shows a perspective, cut-away view of a completion of the example wellbore assembly shown in FIG. 1.

FIG. 3 shows a partial cutaway view of the completion 102. As shown, the mandrel 119 and motor 202 (e.g., electric motor) can reside inside the housing 114. The motor 202 is coupled with a gear 204 that engages and rotates a gear 206 of the mandrel 119. As shown in FIG. 4, the mandrel 119 has the first fluid conduit 210 and second fluid conduit 212, and the housing has a fluid port 214, the first fluid inlet 128, and the second fluid inlet 130. The fluid port 214 is fluidly coupled with the production string.

In FIG. 4, the mandrel 119 is in the second position, in which the second fluid conduit 212 is aligned with both (i)

the top fluid port 214 of the housing and (ii) the second fluid inlet 130 to open a fluid pathway that extends from the second fluid inlet 130 to the fluid port 214. In the first position, the first fluid conduit 210 is aligned with the fluid port 214 and the first fluid inlet 128 to open a straight, vertical fluid pathway from the first fluid inlet 128 to the fluid port 214. The diameter of the conduits 210, 212 and the diameter of the corresponding housing conduits are sized to allow tools (e.g., wireline tools or coiled tubing) to pass through them. In other words, the fluid pathways formed in the first and second positions allow production but also allow tools to pass through the fluid pathways to perform various operations.

In some aspects, the completion 102 has one or more sensors 216 coupled with the mandrel 119 or the housing 114. The sensor 216 is communicatively coupled with the receiver at the surface (e.g., the receiver of the controller or a different receiver) and configured to transmit sensor feedback to the receiver. The sensor feedback includes, for example, an orientation of the mandrel 119 to guide at least one of (i) a placement (e.g., position or orientation) of the housing 114 at the juncture, or (ii) a rotation of the mandrel 119 with respect to the housing 114 to open or close the first fluid pathway or second fluid pathway. For example, the one or more sensors can include a GYRO sensor that can determine the orientation of the two entries prior/conduits to operating the mandrel. It can also support in positioning the entries with high accuracy while in operation. In some aspects, the GYRO sensor allows real-time orientation feedback during mandrel rotation.

Figure 6:
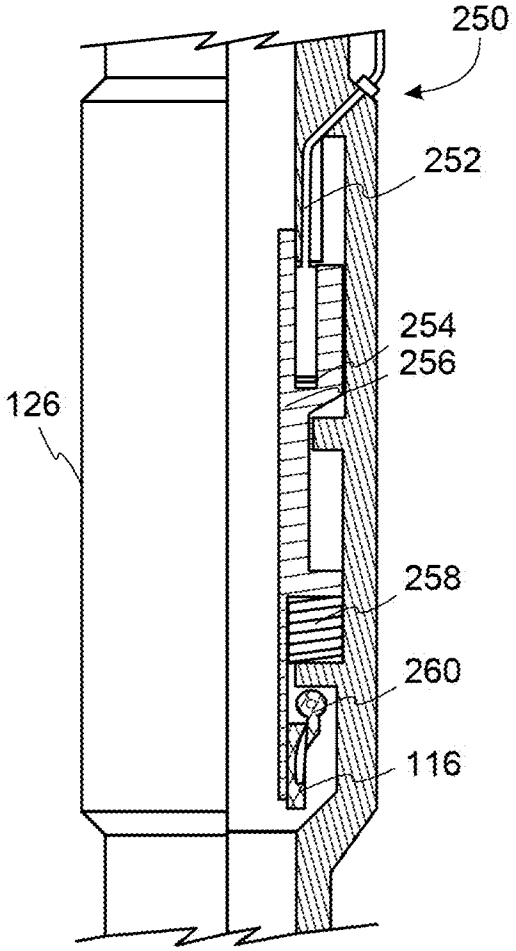
FIG. 6 shows a schematic, partially cross-sectional view of the valve mechanism of the example wellbore assembly, with the valve opened.
Figure 5:
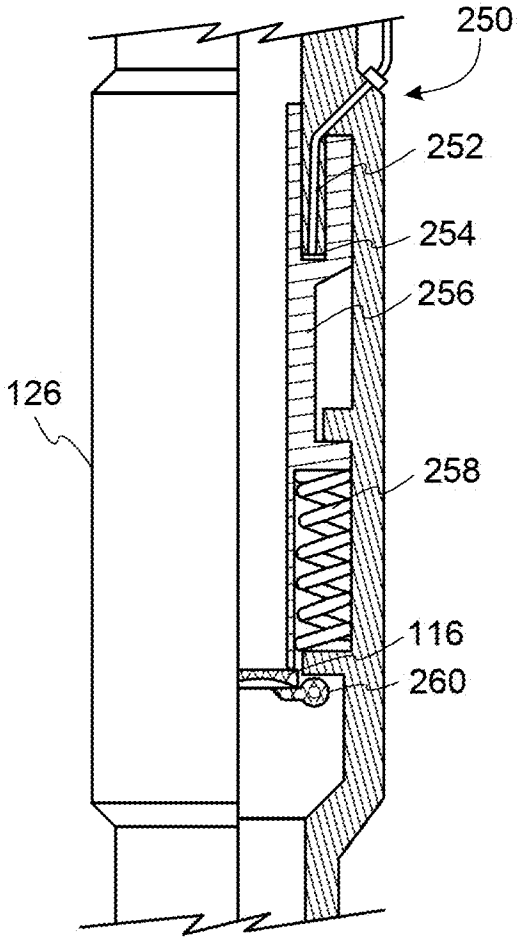
FIG. 5 shows a schematic, partially cross-sectional view of a valve mechanism of the example wellbore assembly, with the valve closed.

FIGS. 5 and 6 show partial cross-sectional views of the downhole production tubing 126 showing the valve 116 and part of the hydraulic mechanism 250 used to move the valve 116. For example, the valve 116 is operable by a linear actuator 256 that can be a spring-loaded tube. The spring-loaded tube is movable under pressure of a fluid flowed by a fluid pump (shown in FIG. 1). The hydraulic fluid flows down from the surface pump through a fluid line 252 (e.g., a hydraulic fluid line, hose, or tube) that pushes the tube in a downhole direction. For example, as shown in FIG. 6, the hydraulic fluid pushes a piston 254 disposed in a recess of the spring-loaded tube to push the tube down. As the tube is pushed down, the tube compresses a spring 258 and open the valve 116. The valve 116 can be attached to a pivot 260 such that the valve pivotally rotates as the tube is pushed down. As the hydraulic fluid is depressurized (e.g., flowed back up), the spring pushed up and the valve 116 closes. The pump can be controlled by the surface controller. Thus, the spring-loaded tube is movable by the controller to either (i) push, with the fluid, the spring-loaded tube downhole to open the flapper valve 116, or (ii) reduce a pressure of the fluid to allow a spring 258 of the spring-loaded tube to push the spring-loaded tube uphole to close the flapper valve 116.

Figure 7:
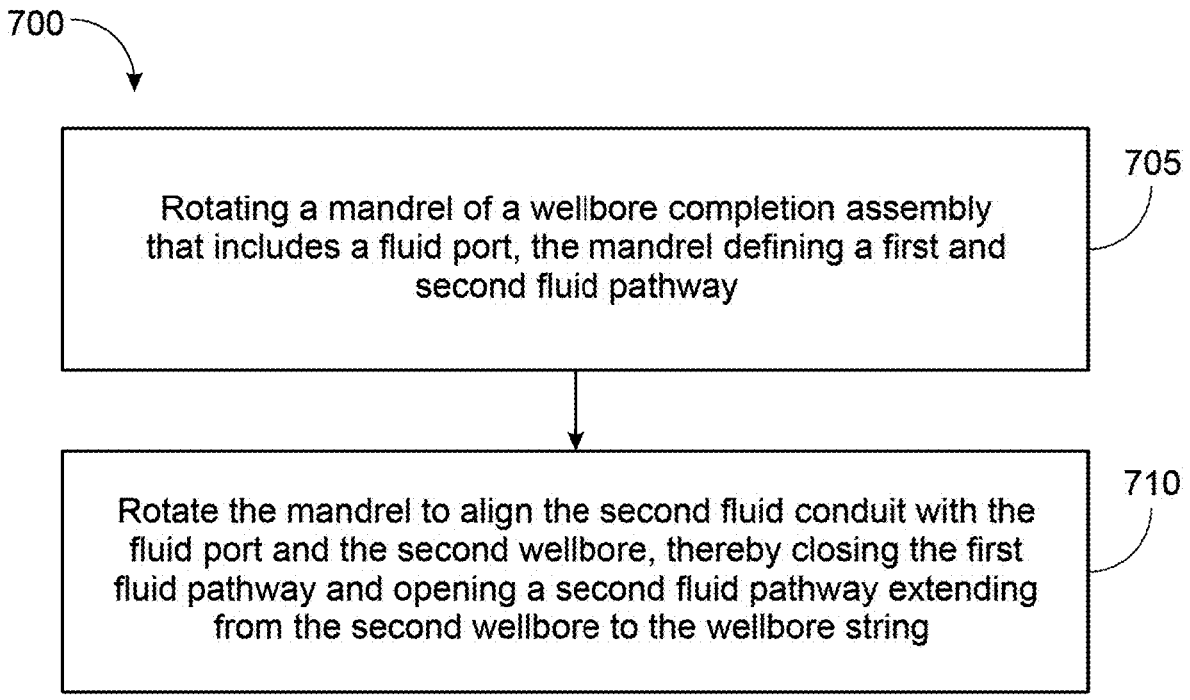
FIG. 7 shows a flow chart of an example method of producing a well.

FIG. 7 shows a flow chart of an example method (700) of regulating a flow of production fluid in a well. The method includes rotating a mandrel of a wellbore completion assembly (705). The wellbore completion assembly can be, for example similar to the wellbore completion assembly 100 in FIG. 1. The method also includes rotating the mandrel to align the second fluid conduit with the fluid port and the second wellbore, thereby closing the first fluid pathway and opening a second fluid pathway extending from the second wellbore to the wellbore string.

To produce the well from the vertical section, the flapper valve is opened through and the SSD is closed to isolate the flow from the horizontal section. To produce the well from the horizontal section, the flapper valve is closed and the SSD is opened and/or the horizontal section is opened by rotating the mandrel to allow flow from the horizontal access.

Figure 8:
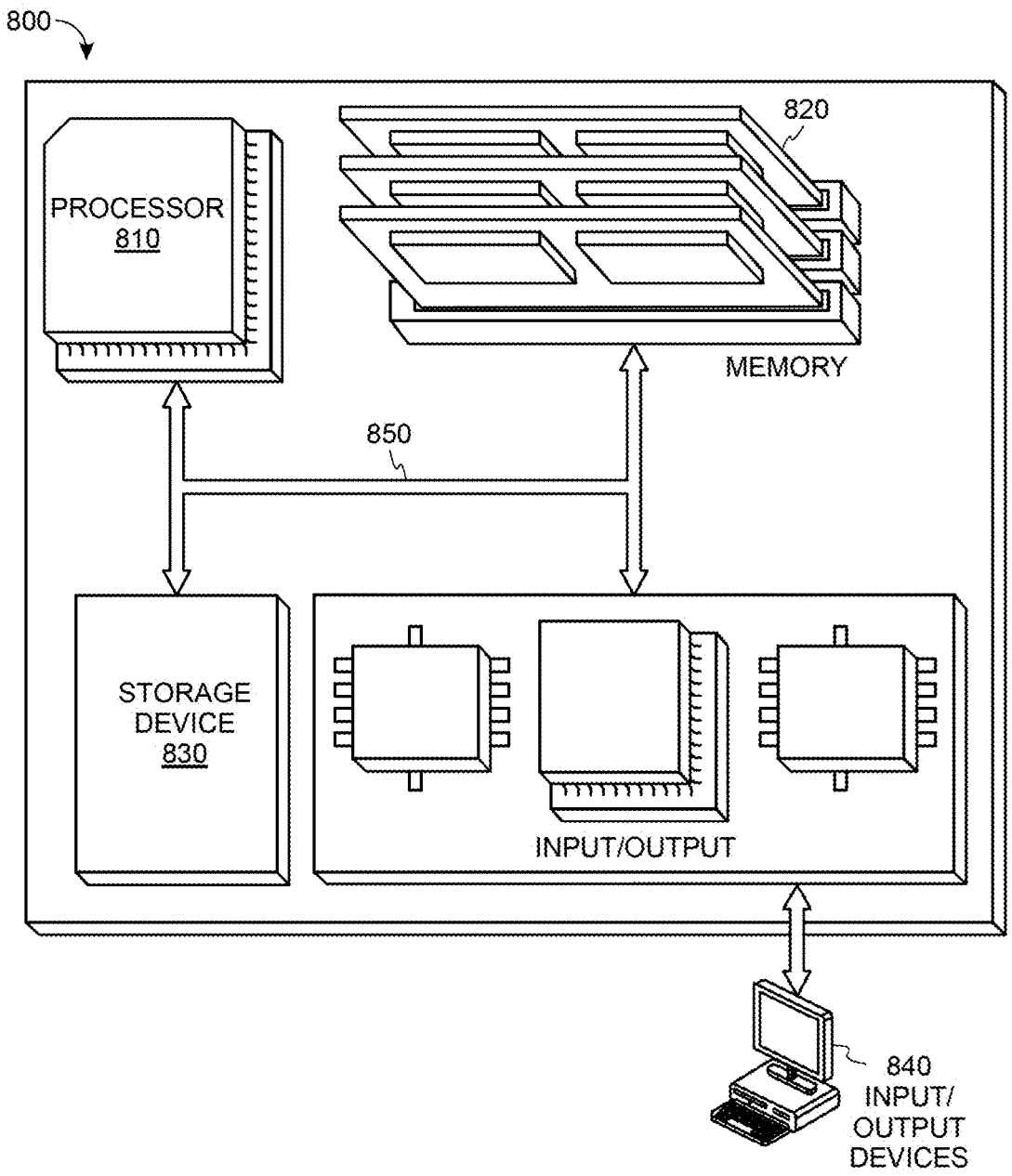
FIG. 8 shows a schematic illustration of an example control system or controller.

FIG. 8 is a schematic illustration of an example control system or controller for a wellbore assembly according to the present disclosure. For example, the controller 800 may be, include, or be part of the controller 120 shown in FIG. 1. The controller 800 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 800 includes a processor 810, a memory 820, a storage device 830, and an input/output device 840. Each of the components 810, 820, 830, and 840 are interconnected using a system bus 850. The processor 810 is capable of processing instructions for execution within the controller 800. The processor may be designed using any of a number of architectures. For example, the processor 810 may be a CISC (Complex Instruction Set Computers) processor, a RISC (Reduced Instruction Set Computer) processor, or a MISC (Minimal Instruction Set Computer) processor.

In one implementation, the processor 810 is a single-threaded processor. In another implementation, the processor 810 is a multi-threaded processor. The processor 810 is capable of processing instructions stored in the memory 820 or on the storage device 830 to display graphical information for a user interface on the input/output device 840.

The memory 820 stores information within the controller 800. In one implementation, the memory 820 is a computer-readable medium. In one implementation, the memory 820 is a volatile memory unit. In another implementation, the memory 820 is a non-volatile memory unit.

The storage device 830 is capable of providing mass storage for the controller 800. In one implementation, the storage device 830 is a computer-readable medium. In various different implementations, the storage device 830 may be a floppy disk device, a hard disk device, an optical disk device, or a tape device.

The input/output device 840 provides input/output operations for the controller 800. In one implementation, the input/output device 840 includes a keyboard and/or pointing device. In another implementation, the input/output device 840 includes a display unit for displaying graphical user interfaces.

The disclosure has discussed the use of a split pod for tubing-deployed ESP system, which can be installed and retrieved using a rig. However, the split pod can also be used in a rigless system, such as in a coiled-tubing deployed ESP system with the power cable attached to the other diameter of the coiled tubing. The configuration could be the same as shown in FIG. 1, with the main exception being that the production tubing is replaced with a coiled tubing.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

In an example implementation, a wellbore completion includes a housing and a mandrel. The housing is coupled with a downhole end of a wellbore string disposed within a well, the well comprising a first wellbore and a second wellbore extending from the first wellbore at a juncture of the well, the housing residing at or near the juncture and comprising: a fluid port fluidly coupled with the wellbore string, a first fluid inlet fluidly coupled with the first wellbore, and a second fluid inlet fluidly coupled with the second wellbore. The mandrel is disposed within the housing and residing downhole of the fluid port, the mandrel comprising a first fluid conduit and a second fluid conduit; wherein the mandrel is rotatable to position the mandrel in a first position, in which the first fluid conduit is aligned with the fluid port and the first fluid inlet to open a fluid pathway from the first wellbore to the wellbore string, or a second position, in which the second fluid conduit is aligned with the fluid port and the second fluid inlet to open a second fluid pathway from the second wellbore to the wellbore string.

In an example implementation combinable with any other example implementation, the mandrel is rotatable by an electric motor, the electric motor controllable from a terranean surface of the well. In an example implementation combinable with any other example implementation, the wellbore completion further comprises a controller disposed at the terranean surface of the well and a cable coupled with the controller and the electric motor to transmit information from the controller to the electric motor to control the electric motor.

In an example implementation combinable with any other example implementation, the first wellbore is a vertical wellbore and the second wellbore is a non-vertical wellbore.

In an example implementation combinable with any other example implementation, the housing is a completion housing coupled with production tubing residing downhole of the housing and disposed within the first wellbore, the production tubing fluidly coupled with the first fluid inlet of the completion housing.

In an example implementation combinable with any other example implementation, the wellbore completion further comprises a flapper valve coupled with the production tubing, the flapper valve operable to open or close a fluid pathway from the production tubing to the completion housing. In an example implementation combinable with any other example implementation, the flapper valve is operable by a linear actuator, the linear actuator controllable from a terranean surface of the well. In an example implementation combinable with any other example implementation, the wellbore completion further comprises a controller disposed at the terranean surface of the well and a cable coupled with the controller and the linear actuator to transmit information from the controller to the linear actuator to open or close the flapper valve. In an example implementation combinable with any other example implementation, the linear actuator is a hydraulic actuator comprising a spring-loaded tube movable under pressure of a fluid flowed by a fluid pump, the fluid pump operable by the controller to either (i) push, with the fluid, the spring-loaded tube downhole to open the flapper valve, or (ii) reduce a pressure of the fluid to allow a spring of the spring-loaded tube to push the spring-loaded tube uphole to close the flapper valve.

In another example implementation, a wellbore assembly includes a housing and a mandrel. The housing is configured to be coupled with a wellbore string. The housing resides at or near a juncture between a first wellbore and a second wellbore. The housing has a fluid port that is, with the housing coupled with the wellbore string, fluidly coupled with the wellbore string. The mandrel is coupled with the housing and residing downhole of the fluid port, the mandrel comprising a first fluid conduit and a second fluid conduit, the mandrel being rotatable to at least one of (i) align the first fluid conduit with the fluid port and the first wellbore to open a first fluid pathway from the first wellbore to the wellbore string, or (ii) align the second fluid conduit with the fluid port and the second wellbore to open a second fluid pathway from the second wellbore to the wellbore string.

In an example implementation combinable with any other example implementation, the wellbore assembly further includes a sliding sleeve door (SSD) coupled with the wellbore string and residing uphole of the housing, the SSD configured to open or close a fluid pathway between the second wellbore and the production string. In an example implementation combinable with any other example implementation, the wellbore assembly further comprises a first packer residing uphole of the SSD and a downhole packer residing downhole of the mandrel, the juncture disposed between the first packer and the second packer such that the first packer isolates the second wellbore from an annulus uphole of the first packer and the second packer isolates the first wellbore from the second wellbore.

In an example implementation combinable with any other example implementation, the wellbore assembly further comprises a controller electrically coupled with and configured to control an electric motor coupled with the mandrel to rotate the mandrel in response to receiving information from the controller.

In an example implementation combinable with any other example implementation, the wellbore assembly further comprises a flapper valve coupled downhole of the housing, the flapper valve operable by a linear actuator, the controller electrically coupled with and configured to control the linear actuator to open or close the flapper valve in response to receiving information from the controller to regulate a flow of fluid from the vertical wellbore into the housing. In an example implementation combinable with any other example implementation, the linear actuator is a hydraulic actuator comprising a spring-loaded tube movable under pressure of a fluid flowed by a fluid pump, the fluid pump operable by the controller to either (i) push, with the fluid, the spring-loaded tube downhole to open the flapper valve, or (ii) reduce a pressure of the fluid to allow a spring of the spring-loaded tube to push the spring-loaded tube uphole to close the flapper valve.

In an example implementation combinable with any other example implementation, the first wellbore is a vertical wellbore and the second wellbore is a non-vertical wellbore.

In an example implementation combinable with any other example implementation, the wellbore assembly further comprises a sensor coupled with the mandrel, the sensor communicatively coupled with a receiver and configured to transmit sensor feedback to the receiver, the sensor feedback comprising an orientation of the mandrel to guide at least one of (i) a placement of the housing at the juncture, or (ii) a rotation of the mandrel with respect to the housing to open or close the first fluid pathway or second fluid pathway.

In another example implementations, a method comprises rotating a mandrel of a wellbore completion assembly, the wellbore completion assembly comprising: a housing coupled with a wellbore string and residing at or near a juncture between a first wellbore and a second wellbore, the housing comprising a fluid port fluidly coupled with the wellbore string, and a mandrel coupled with the housing and residing downhole of the fluid port, the mandrel comprising a first fluid conduit and a second fluid conduit, the mandrel being rotatable to at least one of (i) align the first fluid conduit with the fluid port and the first wellbore, or (ii) align the second fluid conduit with the fluid port and the second wellbore, wherein rotating the mandrel comprises rotating the mandrel to align the first fluid conduit with the fluid port and the first wellbore, opening a first fluid pathway extending from the first wellbore to the wellbore string. The method also includes rotating the mandrel to align the second fluid conduit with the fluid port and the second wellbore, closing the first fluid pathway and opening a second fluid pathway extending from the second wellbore to the wellbore string.

In an example implementation combinable with any other example implementation, the method further comprises, before rotating the mandrel to open the first fluid pathway, determining, by controller and as a function of sensor feedback or an operator input, that the first fluid pathway is to be opened. In an example implementation combinable with any other example implementation, the sensor feedback is sensor feedback from one or more sensors coupled with the wellbore string, the sensor feedback comprising at least one of a flow rate, pressure, or temperature of production fluid in the wellbore string.

What is claimed is:

1. A wellbore completion, comprising:

a housing coupled with a downhole end of a wellbore string disposed within a well, the well comprising a first wellbore and a second wellbore extending from the first wellbore at a juncture of the well, the housing residing at or near the juncture and comprising:

a fluid port fluidly coupled with the wellbore string, a first fluid inlet fluidly coupled with the first wellbore, and a second fluid inlet fluidly coupled with the second wellbore; and a mandrel disposed within the housing and residing downhole of the fluid port, the mandrel comprising a first fluid conduit and a second fluid conduit;

wherein the mandrel is rotatable to position the mandrel in a first position, in which the first fluid conduit is aligned with the fluid port and the first fluid inlet to open a fluid pathway from the first wellbore to the wellbore string, or a second position, in which the second fluid conduit is aligned with the fluid port and the second fluid inlet to open a second fluid pathway from the second wellbore to the wellbore string.

2. The wellbore completion of claim 1, wherein the mandrel is rotatable by an electric motor, the electric motor controllable from a terranean surface of the well.

3. The wellbore completion of claim 2, further comprising a controller disposed at the terranean surface of the well and a cable coupled with the controller and the electric motor to transmit information from the controller to the electric motor to control the electric motor.

4. The wellbore completion of claim 1, wherein the first wellbore is a vertical wellbore and the second wellbore is a non-vertical wellbore.

5. The wellbore completion of claim 1, wherein the housing is a completion housing coupled with production tubing residing downhole of the housing and disposed within the first wellbore, the production tubing fluidly coupled with the first fluid inlet of the completion housing.

6. The wellbore completion of claim 5, further comprising a flapper valve coupled with the production tubing, the flapper valve operable to open or close a fluid pathway from the production tubing to the completion housing.

7. The wellbore completion of claim 6, wherein the flapper valve is operable by a linear actuator, the linear actuator controllable from a terranean surface of the well.

8. The wellbore completion of claim 7, further comprising a controller disposed at the terranean surface of the well and a cable coupled with the controller and the linear actuator to transmit information from the controller to the linear actuator to open or close the flapper valve.

9. The wellbore completion of claim 8, wherein the linear actuator is a hydraulic actuator comprising a spring-loaded tube movable under pressure of a fluid flowed by a fluid pump, the fluid pump operable by the controller to either (i) push, with the fluid, the spring-loaded tube downhole to open the flapper valve, or (ii) reduce a pressure of the fluid to allow a spring of the spring-loaded tube to push the spring-loaded tube uphole to close the flapper valve.

10. A wellbore assembly, comprising:

a housing configured to be coupled with a wellbore string, the housing configured to reside at or near a juncture between a first wellbore and a second wellbore, the housing comprising a fluid port that is, with the housing coupled with the wellbore string, fluidly coupled with the wellbore string; and a mandrel coupled with the housing and residing downhole of the fluid port, the mandrel comprising a first fluid conduit and a second fluid conduit, the mandrel being rotatable to at least one of (i) align the first fluid conduit with the fluid port and the first wellbore to open a first fluid pathway from the first wellbore to the wellbore string, or (ii) align the second fluid conduit with the fluid port and the second wellbore to open a second fluid pathway from the second wellbore to the wellbore string.

11. The wellbore completion of claim 10, further comprising a sliding sleeve door (SSD) coupled with the wellbore string and residing uphole of the housing, the SSD configured to open or close a fluid pathway between the second wellbore and the production string.

12. The wellbore completion of claim 11, further comprising a first packer residing uphole of the SSD and a downhole packer residing downhole of the mandrel, the juncture disposed between the first packer and the second packer such that the first packer isolates the second wellbore from an annulus uphole of the first packer and the second packer isolates the first wellbore from the second wellbore.

13. The wellbore completion of claim 10, further comprising a controller electrically coupled with and configured to control an electric motor coupled with the mandrel to rotate the mandrel in response to receiving information from the controller.

14. The wellbore completion of claim 13, further comprising a flapper valve coupled downhole of the housing, the flapper valve operable by a linear actuator, the controller electrically coupled with and configured to control the linear actuator to open or close the flapper valve in response to receiving information from the controller to regulate a flow of fluid from the vertical wellbore into the housing.

15. The wellbore completion of claim 14, wherein the linear actuator is a hydraulic actuator comprising a spring-loaded tube movable under pressure of a fluid flowed by a fluid pump, the fluid pump operable by the controller to either (i) push, with the fluid, the spring-loaded tube downhole to open the flapper valve, or (ii) reduce a pressure of the fluid to allow a spring of the spring-loaded tube to push the spring-loaded tube uphole to close the flapper valve.

16. The wellbore completion of claim 10, wherein the first wellbore is a vertical wellbore and the second wellbore is a non-vertical wellbore.

17. The wellbore completion of claim 10, further comprising a sensor coupled with the mandrel, the sensor communicatively coupled with a receiver and configured to transmit sensor feedback to the receiver, the sensor feedback comprising an orientation of the mandrel to guide at least one of (i) a placement of the housing at the juncture, or (ii) a rotation of the mandrel with respect to the housing to open or close the first fluid pathway or second fluid pathway.

18. A method, comprising:

rotating a mandrel of a wellbore completion assembly, the wellbore completion assembly comprising:

a housing coupled with a wellbore string and residing at or near a juncture between a first wellbore and a second wellbore, the housing comprising a fluid port fluidly coupled with the wellbore string, and a mandrel coupled with the housing and residing downhole of the fluid port, the mandrel comprising a first fluid conduit and a second fluid conduit, the mandrel being rotatable to at least one of (i) align the first fluid conduit with the fluid port and the first wellbore, or (ii) align the second fluid conduit with the fluid port and the second wellbore, wherein rotating the mandrel comprises rotating the mandrel to align the first fluid conduit with the fluid port and the first wellbore, opening a first fluid pathway extending from the first wellbore to the wellbore string; and rotating the mandrel to align the second fluid conduit with the fluid port and the second wellbore, closing the first fluid pathway and opening a second fluid pathway extending from the second wellbore to the wellbore string.

19. The wellbore completion of claim 18, further comprising, before rotating the mandrel to open the first fluid pathway, determining, by controller and as a function of sensor feedback or an operator input, that the first fluid pathway is to be opened.

20. The wellbore completion of claim 19, wherein the sensor feedback is sensor feedback from one or more sensors coupled with the wellbore string, the sensor feedback comprising at least one of a flow rate, pressure, or temperature of production fluid in the wellbore string.

* * * * *